US006863258B2

(12) United States Patent
Tupis

(10) Patent No.: US 6,863,258 B2
(45) Date of Patent: Mar. 8, 2005

(54) SEALED DAMPER ASSEMBLY

(75) Inventor: Jeffery Allen Tupis, Louisville, KY (US)

(73) Assignee: General Electric Company, Schenectady, NY (US)

( * ) Notice: Subject to any disclaimer, the term of this patent is extended or adjusted under 35 U.S.C. 154(b) by 288 days.

(21) Appl. No.: 09/754,541

(22) Filed: Jan. 5, 2001

(65) Prior Publication Data

US 2003/0036348 A1 Feb. 20, 2003

(51) Int. Cl.[7] ..... F16K 3/00

(52) U.S. Cl. ..... 251/214; 251/301; 277/412; 62/408

(58) Field of Search ..... 251/214, 298, 251/301, 302; 62/407, 408; 277/412, 418, 419; 16/273, 386

(56) References Cited

U.S. PATENT DOCUMENTS 3,123,098 A * 3/1964 Bishop ..... 137/601.06
3,799,187 A * 3/1974 Armstrong ..... 137/246.22
4,836,499 A * 6/1989 Steele et al. ..... 251/173
5,501,716 A 3/1996 Chiba et al.
5,641,016 A 6/1997 Isaji et al.
5,706,551 A 1/1998 Jeynes et al.
5,799,591 A 9/1998 Anderson
6,006,531 A 12/1999 Pritts et al.
6,092,375 A 7/2000 Denniston
6,240,735 B1 6/2001 Kolson et al.
6,289,787 B1 9/2001 Underwood et al.

* cited by examiner

*Primary Examiner*—Edward K. Look
*Assistant Examiner*—John K. Fristoe, Jr.
(74) *Attorney, Agent, or Firm*—H. Neil Houser, Esq.; Armstrong Teasdale LLP

(57) ABSTRACT

A motorized damper door assembly for use in freezing temperature applications includes a damper frame, a damper door having, a mounting portion rotatably mounted to the frame, and a seal member having a vertically extending moisture barrier adjacent the mounting portion. The door mounting portion and the moisture barrier together form a reservoir inside the door mounting portion to prevent moisture from seeping directly into the motor housing below the door mounting portion. Consequently, as moisture accumulation in the motor housing is avoided, associated damper jamming and impaired performance issues are also avoided.

20 Claims, 1 Drawing Sheet

SEALED DAMPER ASSEMBLY

BACKGROUND OF THE INVENTION

This invention relates generally to motorized dampers, and, more particularly, to motorized dampers for use in freezing temperature conditions.

At least one type of motorized damper includes a damper door rotatably mounted in a damper frame having an opening therethrough. An electric motor is coupled to the damper door and positions the damper door in desired positions relative to the damper frame opening. When located in, for example, an air flow path, air flow through the damper can be regulated by positioning the damper door to, for example, a fully closed position substantially preventing airflow through the damper frame opening, a fully open position where airflow through the damper frame opening is substantially unimpeded, and intermediate positions between the fully open and closed positions.

In certain applications, this type of damper is vulnerable to jamming in cold temperature conditions. For example, refrigerators typically employ one or more of these dampers to regulate airflow between a fresh food compartment and a freezer compartment. The damper is opened to introduce cold air from the freezer compartment into the fresh food compartment to regulate fresh food compartment temperature. The temperature differential between the fresh food compartments and humidity in one or both of the compartments can cause moisture to accumulate on the damper door. The moisture runs down the door and permeates a seal between the damper door and the damper frame, and eventually into the motor housing where it may collect on cam surfaces, gears, and other moving parts of the motor mechanism. Freezing temperatures therefore create ice on the motor mechanism that can jam the damper door, or at least impair its ability to be positioned properly. To meet stringent energy and performance requirements, it is important that the dampers be positioned reliably and accurately.

BRIEF SUMMARY OF THE INVENTION

In an exemplary embodiment, a motorized damper door assembly for use in freezing temperature applications includes a damper frame, a damper door having a mounting portion rotatably mounted to the frame, and a seal member having a vertically extending moisture barrier adjacent the mounting portion. The door mounting portion and the moisture barrier together form a reservoir inside the door mounting portion to prevent moisture from seeping directly into the motor housing below the door mounting portion. Rather, moisture can enter the motor housing only after rising to the level exceeding the height of the moisture barrier.

With strategic selection of moisture barrier height, moisture entry into the motor housing is practically eliminated. Consequently, as moisture accumulation in the motor housing is avoided, associated damper jamming and impaired performance issues are also avoided. A reliable and cost effective motorized damper assembly is therefore provided that may be used in low temperature conditions and environments, such as in a refrigerator, to more capably meet applicable energy and performance objectives.

DETAILED DESCRIPTION OF THE INVENTION

Figure 1:
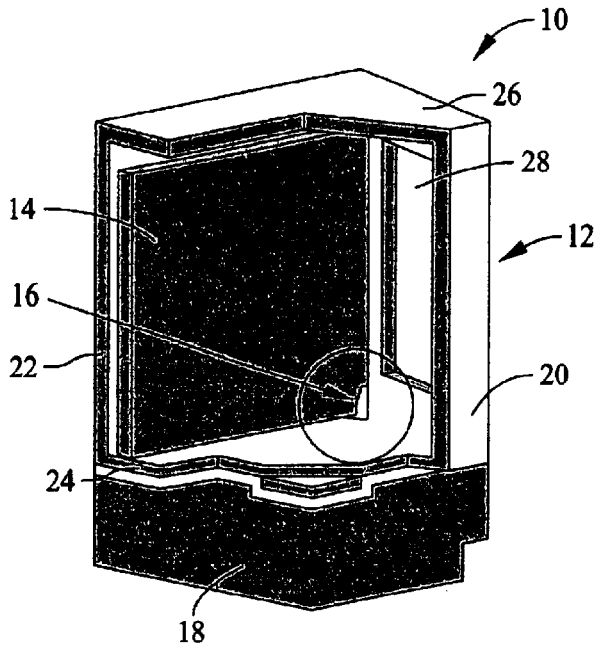
FIG. 1 is a perspective view of a sealed motorized damper assembly.

FIG. 1 is a perspective view of a motorized damper assembly 10 suitable for use in low temperature conditions, i.e., temperatures at or below freezing, such as those encountered in various refrigerators and refrigeration appliances. It is understood, however, that other applications of motorized dampers introduce similar concerns as those redressed by the present invention. Therefore, as the benefits of the invention accrue generally to motorized dampers used in a variety of applications wherein low temperature conditions present conditions conducive to frozen, jammed or impaired motor mechanisms, the present invention is not intended to be limited to any particular low temperature application, such as in a refrigerator.

Damper door assembly 10 includes a door frame 12, a damper door 14 including a sealed mounting assembly 16, and a known motor 18 for adjusting a position of damper door 14. Door frame 12 includes a first side 20, a second side 22, a bottom 24 and a top 26. Frame first side 20 includes a damper opening 28 therethrough, and damper door 14 is rotatably mounted to frame bottom 24 and to frame top 26 and is dimensioned at least equally to the dimensions of damper opening 28 to regulate airflow therethrough. Damper door 14 is selectively positionable between a fully open position wherein airflow through damper opening 28 is substantially unimpeded by damper door 14, as shown in FIG. 1, a fully closed position (not shown) wherein damper door 14 substantially prevents airflow through damper opening 28, as well as to any desired position between the fully open and fully closed position.

Damper door 14 is substantially vertically mounted in damper door assembly 10, i.e., damper door 14 rotates about a substantially vertical axis. Thus, any moisture accumulating on damper door 14 is drawn by gravity to a lower end of damper door 14, and sealed mounting assembly 16 is located in the lower end of damper door 14 and frame bottom portion 24 to prevent moisture from entering motor 18. Thus, potential freezing of moisture on motor mechanism components (not shown) therein is avoided. For example, in one embodiment, damper door 14 is rotated by an eccentric pivot pin (not shown in FIG. 1) engaged with damper door 14 and coupled to a cam (not shown) that is, in turn, driven by gears (not shown) coupled to the motor output shaft (not shown). Thus, as the motor shaft rotates, damper door 14 is rotated open and closed. It is contemplated, however, that the sealed assembly of the present invention may be used with alternative door rotating arrangements known in the art, and furthermore may be used to seal other openings (not shown) in frame bottom portion 24 that present potential moisture leaks into motor 18 which may impair performance of damper assembly 10 in low temperature conditions.

Figure 2:
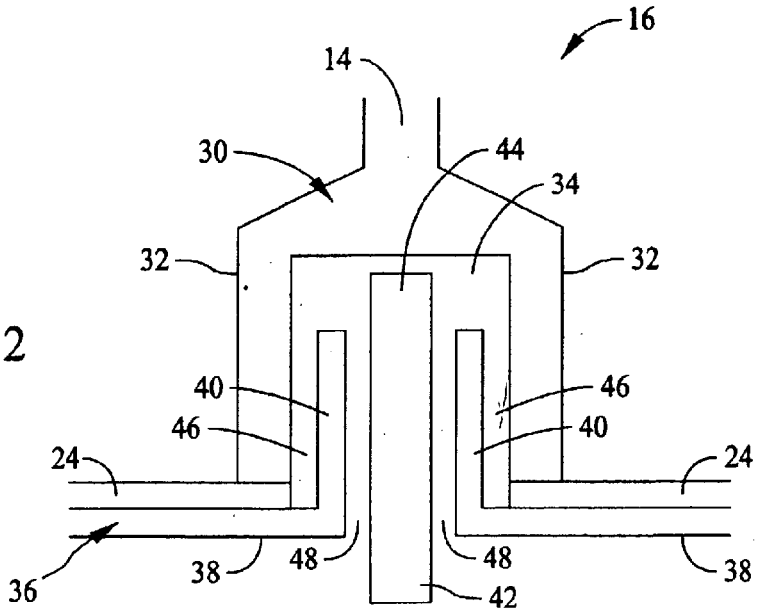
FIG. 2 is a cross sectional view of a portion of the damper assembly shown in FIG. 1.

FIG. 2 is an exaggerated cross-sectional view of sealed mounting assembly 16. Damper door 14 includes a mounting portion 30 including a body 32 defining a hollow chamber 34 therein. Door mounting portion 30 extends above frame bottom portion 24, and a seal member 36 extends below frame bottom portion 24 and includes a horizontal portion 38 and a vertical moisture barrier 40 extending from horizontal portion 38 inside mounting portion chamber 34. A door pivot pin 42 is received within moisture barrier 40. In one embodiment, door pivot pin 42 is eccentrically shaped on at least at one end 44 and coupled to a motor mechanism, such as a motor driven cam (not shown). When the cam is rotated by the motor shaft, eccentric end 44 contacts door mounting portion 30 to rotate damper door 14 and change its position. In another embodiment, door pivot pin 42 is stationary and door mounting portion 30 rotates about pivot pin 42 as it rotated by a cam driven arrangement (not shown) engaging damper door 14 elsewhere than on door mounting portion 30.

Seal member moisture barrier 40 extends upwardly into mounting portion chamber 34 within door mounting portion body 32. Mounting portion chamber 34 is therefore effectively separated into an outer chamber 46 extending between moisture barrier 40 and door mounting portion body 32, and an inner chamber 48 extending between seal member moisture barrier 40 and door pivot pin 42. Outer chamber 46 forms a reservoir to prevent moisture from entering inner chamber 48 and reaching components of motor 18 (shown in FIG. 1) unless the moisture travels upwardly, against gravitational forces, a sufficient height to surpass moisture barrier 40. With strategic selection of moisture barrier 40 height, moisture entry into motor 18 can be practically eliminated.

In an exemplary embodiment, seal member 36 extends from damper frame bottom portion 24, and is attached to frame bottom portion 24 in a known manner to adequately seal the connection between seal member 36 and frame bottom portion 24. In an alternative embodiment seal member 36 is integral to frame bottom portion 24. Seal member 36 is fabricated from known materials and techniques so that seal member 36 is capable of withstanding expected temperature conditions in use, and in different embodiments is fabricated from the same or different materials as other components of motorized door assembly 10.

Further, moisture barrier 40 and door mounting portion body 32, in an exemplary embodiment, extend substantially parallel to one another. In a further embodiment moisture barrier 40 and door mounting portion 32 extend substantially vertically. It is contemplated, however, that an adequate reservoir can be created in outer chamber 46 if one or both of moisture barrier 40 and door mounting portion body 32 are inclined, whether parallel or in a nonparallel fashion.

In addition, in an exemplary embodiment, door mounting portion body 32 is substantially cylindrical, thereby forming a cylindrical mounting portion chamber 34 therein, and moisture barrier 40 is complementary in shape to mounting portion chamber 34. In alternative embodiments, however, other shapes of door mounting body 32, mounting body chamber 34, and moisture barrier 40 may be employed to achieve the benefits of the instant invention, including non-complementary shapes of door mounting body 32, mounting body chamber 34, and moisture barrier 40.

While the invention has been described in terms of various specific embodiments, those skilled in the art will recognize that the invention can be practiced with modification within the spirit and scope of the claims.

What is claimed is:

1. A motorized damper door assembly comprising:

a damper frame;

a damper door comprising a mounting portion rotatably mounted to said frame; and a seal member comprising a substantially vertically extending moisture barrier defining a chamber between said mounting portion and said moisture barrier.

2. A damper door assembly in accordance with claim 1, said mounting portion and said moisture barrier forming a reservoir.

3. A damper door assembly in accordance with claim 2 wherein said damper door mounting portion comprises a mounting body and a hollow mounting chamber within said mounting body.

4. A damper door assembly in accordance with claim 3, said moisture barrier located within said mounting body.

5. A damper door assembly in accordance with claim 4, further comprising a door pivot pin, said pivot pin received in said moisture barrier.

6. A damper door assembly in accordance with claim 4, said moisture barrier extending substantially parallel to said mounting body.

7. A damper door assembly in accordance with claim 1 wherein said moisture barrier extends from said damper frame.

8. A motorized damper door assembly comprising:

a damper frame;

a damper door comprising a mounting portion rotatably mounted to said frame; and a seal member extending from said damper frame and forming a reservoir in said mounting portion.

9. A damper door assembly in accordance with claim 8 wherein said damper door mounting portion comprises a mounting body and a hollow mounting chamber within said mounting body.

10. A damper door assembly in accordance with claim 9, said seal member comprising a substantially vertically extending moisture barrier.

11. A damper door assembly in accordance with claim 10, said moisture barrier located within said mounting body.

12. A damper door assembly in accordance with claim 11, further comprising a door pivot pin, said pivot pin received in said moisture barrier.

13. A damper door assembly in accordance with claim 11, said moisture barrier extending substantially parallel to said mounting body.

14. A damper door assembly in accordance with claim 11 wherein said moisture barrier extends from said door frame.

15. A motorized damper assembly for a refrigerator, said damper assembly comprising:

a damper frame;

a damper door comprising a mounting portion rotatably mounted to said frame;

a seal member comprising a substantially vertically extending moisture barrier extending within said mounting portion; and a door pivot pin located within said moisture barrier.

16. A damper assembly in accordance with claim 15, said mounting portion and said moisture barrier forming a reservoir.

17. A damper door assembly in accordance with claim 16 wherein said damper door mounting portion comprises a mounting body and a hollow mounting chamber within said mounting body.

18. A damper door assembly in accordance with claim 17, said moisture barrier extending substantially parallel to said mounting body.

19. A damper door assembly in accordance with claim 15 wherein said moisture barrier extends from said door frame.

20. A damper door assembly in accordance with claim 15 further comprising a motor adjacent said door frame and coupled to said door pivot.

* * * * *